US007992326B2

(12) United States Patent
Trinkaus et al.

(10) Patent No.: US 7,992,326 B2
(45) Date of Patent: Aug. 9, 2011

(54) SPORTS SHOE, IN PARTICULAR AN ALPINE SKI SHOE

(75) Inventors: Gerhard Trinkaus, Köflach (AT); Helmut Holzer, St. Johann (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 874 days.

(21) Appl. No.: 11/975,179

(22) Filed: Oct. 18, 2007

(65) Prior Publication Data

US 2008/0209768 A1 Sep. 4, 2008

(30) Foreign Application Priority Data

Oct. 19, 2006 (AT) ..... A 1745/2006

(51) Int. Cl.
*A43B 5/00* (2006.01)

(52) U.S. Cl. ..... 36/117.3; 36/97; 36/117.1

(58) Field of Classification Search ..... 36/117.3, 36/97, 117.1, 102, 103
See application file for complete search history.

(56) References Cited

U.S. PATENT DOCUMENTS

| | | | | |
|---|---|---|---|---|
| 4,261,114 | A | 4/1981 | Viletto | |
| 4,941,273 | A | 7/1990 | Gross | |
| 5,189,815 | A * | 3/1993 | Pozzobon et al. | 36/117.3 |
| 5,572,806 | A * | 11/1996 | Osawa | 36/117.4 |
| 5,992,861 | A | 11/1999 | Piotrowski | |
| 5,992,872 | A * | 11/1999 | Proctor | 280/611 |
| 6,065,228 | A * | 5/2000 | Begey et al. | 36/15 |
| 6,119,374 | A | 9/2000 | Bollard et al. | |
| 6,138,385 | A * | 10/2000 | Jungkind et al. | 36/97 |
| 6,237,255 | B1 * | 5/2001 | Renaudin et al. | 36/97 |
| 6,438,872 | B1 * | 8/2002 | Chil et al. | 36/97 |
| 6,446,363 | B1 | 9/2002 | Artus | |
| 6,588,125 | B2 * | 7/2003 | Proctor, Sr. | 36/117.1 |
| 6,807,754 | B2 * | 10/2004 | Miller et al. | 36/97 |
| 2005/0060913 | A1 * | 3/2005 | Chil et al. | 36/97 |
| 2005/0115114 | A1 * | 6/2005 | Miller et al. | 36/97 |
| 2006/0130371 | A1 * | 6/2006 | Schneider | 36/97 |

FOREIGN PATENT DOCUMENTS

| | | |
|---|---|---|
| DE | 27 31 557 | 6/1978 |
| DE | 27 23 884 | 11/1978 |
| DE | 198 53 077 | 6/1999 |

(Continued)

*Primary Examiner* — Marie Patterson
(74) *Attorney, Agent, or Firm* — Collard & Roe, P.C.

(57) ABSTRACT

The invention relates to a sports shoe (1), in particular an alpine ski shoe (2), with an adjusting means (3) for varying the stiffness of the sole system (4) as and when necessary. This adjusting means (3) comprises at least one profiled tension element (19) which remains essentially dimensionally stable when forces act on it and which is connected at its oppositely lying end portions to a front sole platform (10) on the one hand and to a rear sole platform (11) of the sole system (4) on the other hand, its middle portion extending freely between the front and the rear sole platform (10, 11). The tension element (19) is mounted so as to be relatively displaceable in the longitudinal direction of the sole system (4) in order to apply adjustable positioning forces relative to at least one sole platform (10, 11), and an individually adjustable tensing force can be expended between the front and the rear sole platform (10, 11) via the tension element (19). This tensing force can be adjusted so that at least one load-induced tendency of a distance (25) between the front and rear sole platform (10, 11) to become bigger is counteracted or a tendential vertical lifting of the middle portion of the sole system (4) is induced.

28 Claims, 3 Drawing Sheets

FOREIGN PATENT DOCUMENTS

| | | |
|---|---|---|
| DE | 101 45 685 | 4/2003 |
| DE | 103 35 970 | 2/2005 |
| EP | 0 672 365 | 9/1995 |
| EP | 0 930 027 | 7/1999 |
| WO | WO 92/18023 | 10/1992 |
| WO | WO 96/02157 | 2/1996 |
| WO | WO 01/35780 | 5/2001 |

* cited by examiner

SPORTS SHOE, IN PARTICULAR AN ALPINE SKI SHOE

Applicants claim priority under 35 U.S.C. §119 of AUSTRIAN Patent Application No. A 1745/2006 filed on Oct. 19, 2006.

BACKGROUND OF THE INVENTION

1. Field of the Invention

The invention relates to a sports shoe, in particular an alpine ski shoe, as defined in claim 1.

2. Prior Art

Sports shoes, in particular alpine ski shoes, with an adjusting means for changing the stiffness of the sole and the flexibility of the shoe upper, are known from the prior art and exist in a large number of different designs.

Patent specification DE 198 53 077 A1, for example, proposes an alpine ski shoe with a shaft of a flexible design. This ski shoe is also provided with a sole which enables the foot to bend when walking. The flexible sole has—as is standard for an alpine ski shoe—stiff end zones, which extend across the shoe upper in the direction towards the front and in the direction towards the rear and are designed so that they can be secured by front and rear binding elements of a standard ski binding. This flexible sole has either sole parts articulatingly connected to one another or an elastic middle sole portion. A lock mechanism may be provided for the articulated portion, by means of which the articulating action or the ability of the sole to deform elastically is prevented. This lock mechanism comprises a bolt arrangement, which can be moved by means of a pair of cables, and these cables are run to an adjusting lever positioned in the rear shaft portion of the shoe. When the lever is in a defined first position, the lock mechanism is deactivated. When the lever is in a second position, the lock mechanism is activated, in which case the bolts are thrust forwards by compression springs and thus prevent or block any flexing or deformation of the shoe sole. With this shoe, therefore, it is possible to switch in one step from a sports shoe of an essentially flexible design to a relatively stiff or inflexible sports shoe and vice versa.

Patent specification WO 01/35780 A1 describes a winter sports shoe, in particular an alpine ski shoe, the front foot shell of which is of a flexible design. Accordingly, a flexible portion is provided in the metatarsal region of the shoe top face, which largely uncouples the shoe front part from the rear part of the sports shoe by force, thereby enabling the shoe front part to pivot or move down in the region of the ball of the foot about an axis extending transversely to the longitudinal extension of the shoe. The flexible transition region between the shoe front part and the rear shoe portion requires special features on the ski binding and special precautionary measures on the ski in the region of the ski binding in order to provide support and improve the transmission of forces to the ski from the sports shoe, which is flexible in the metatarsal portion.

Patent specification U.S. Pat. No. 6,065,228 A describes a sports shoe, to the bottom face of which different sole plates can be interchangeably fitted. In particular, this sports shoe can be fitted with different equipment for use as an alpine-ski shoe, snowboard shoe or a touring ski shoe by changing the front and rear sole plate. This sports shoe, which can be adapted for different types of sports, may also be provided with a shaped means which prevents incorrect assembly. This shaped means is provided in the form of connecting bars between the front and rear sole plate. This offers a reliable way of preventing soles plates designed for different sport standards being mixed up and incorrectly fitted. The proposed designs therefore offer a foolproof way of adapting a specific shoe upper to different standards for sports shoes used for different types of sport.

Patent specification U.S. Pat. No. 5,992,861 A discloses a ski shoe with an essentially stiff-shaped shoe upper, to the bottom face of which individual sole parts can be attached by means of screw connections in different relative positions with respect to the shoe upper. In particular, a front sole platform and a rear sole platform are provided, which can be connected to the shoe sole bottom part in different angular positions relative to the sole longitudinal axis. This permits what is referred to as "canting" between the shoe upper and the shoe sole. It is also proposed that connecting bars be provided between the front and rear sole plate, which are intended to ensure that a relative movement of one of the sole plates causes a corresponding relative movement of the other sole plate with respect to the shoe upper. This mechanical coupling of the movement between the front and rear sole plates therefore ensures that a simultaneous and uniform relative movement of the angular position takes place between the sole system and the shoe upper.

Patent specification U.S. Pat. No. 5,189,815 A describes a ski shoe with flexible weakened portions or orifices in the metatarsal, instep and cuff zone. The integrally formed sole of this ski shoe, manufactured by a plastic injection molding process, may have a pair of receiving bores extending in the longitudinal direction of the sole for a pair of reinforcing elements which are provided in the form of a pair of rods, for example, which can be pushed into the sole of the sports shoe. These rod-shaped reinforcing elements in the shoe sole are intended to compensate for the upper, instep-side weakened portions of the shoe upper. In an alternative embodiment to this one, the reinforcing element is of a plate-type design and is screwed onto the shoe bottom face between a front and a rear adapter plate. The plate-type reinforcing element extends between the front and rear adapter plate and is rigidly connected to the bottom face of the sports shoe via the two adapter plates.

Patent specification U.S. Pat. No. 4,261,114 A describes a ski shoe, the shoe upper and shoe sole of which are of a flexible design, making it possible to improve a rolling movement with the ski shoe when walking. Two receiving bores are provided in the shoe sole, extending essentially parallel with one another starting from the shoe tip in the direction towards the heel portion as a means of accommodating stiffening bars. When at least one stiffening bar is inserted in the receiving bores, the shoe sole and hence the entire ski shoe is rendered stiff, whereas when the stiffening bars are removed, the resultant ski shoe is relatively flexible. Alternatively, a plate-type stiffening element is proposed, which can be attached to the sole bottom face, thereby imparting stiffness to the sole. This means that the stiffening elements have to be changed and have to be kept at the ready for situations when it is necessary to use a flexible ski shoe.

Patent specification DE 27 31 557 A1 describes a ski shoe, the sole length of which or capacity for accommodating a foot can be varied within a specific range. This ski shoe comprises a front shoe portion, which essentially constitutes the shoe tip region and which is mounted so as to be displaceable in the longitudinal direction of the sports shoe relative to the remaining shoe portion. In one embodiment, a threaded rod arrangement is provided between the front shoe portion and the rear shoe portion, by means of which a relative movement of the front shoe portion relative to the rear shoe portion is possible in order to vary the sole length or shoe size. This ski shoe with a variable shoe size therefore operates on the basis of a telescopic variability between the front and the rear shoe portion in order to change the shoe size individually.

Patent specification EP 0 672 365 A2 discloses a ski shoe, the sole system of which has a heel-end sole part and a sole part spaced apart from it in the region of the shoe tip. This sole system also has a longitudinal stiffening means underneath the front foot shell, extending between the heel-end sole part and the front sole part. This longitudinal stiffening means is as torsionally stiff as possible with respect to the longitudinal axis of the sports shoe and is fixedly connected, preferably screwed, to the bottom face of the front foot shell in the region of the front sole part and the rear sole part. The purpose of this longitudinal stiffening means is to increase the torsional stiffness of the sports shoe between the front and the rear sole part, whilst avoiding the occurrence of a cold bridge as far as possible.

Patent specification WO 96/02157 A1 describes a sports shoe with a variable sole stiffness. In this instance, two plate elements are disposed in the in the vertical direction of the sole structure and are displaceable relative to one another, between which an elastically compressible layer is disposed. When the plate parts are pressed against one another, the stiffness of the sole is increased, whereas in the presence of a non-compressed intermediate layer or in the situation where the plate parts are spaced relatively far apart from one another, the sole is significantly more flexible.

Patent specification WO 92/18023 A1 describes a sports shoe or ski shoe with a multi-part sole, which can be adjusted in terms of its length and/or width. This sole has at least two longitudinal portions, and at least some of the sole portions are fixedly connected to the shell of the sports shoe and additional sole portions can be fixed in their relative positions with respect to the shell with the aid of fixing means. These fixing means comprise at least one tensioning means which acts at least in the longitudinal direction of the sole and is designed so that it pushes at least two sole portions against one another. The advantage of the sole parts, which are interchangeable and can be fixed, is that the sports shoe can be adapted rapidly and easily to the respective desired shoe size, at least within a certain range of sizes. This means that a significantly smaller number of injection moulds needs to be kept in stock. This in turn reduces the number of expensive injection moulds accordingly. The tensioning means used for interchangeably fitting the sole parts may be a solid or tubular tension rod, which extends through at least some of the sole portions and is disposed essentially in the sole longitudinal axis. Furthermore, at least one nut-screw arrangement is provided, by means of which a mechanical clamping action can be applied to the co-operating sole portions, which presses the sole portions together in the longitudinal direction, thereby enabling the interchangeable sole parts to be secured on the bottom face of the shell. This results in a ski shoe which can be adapted to different foot sizes but requires little in the way of equipment and time. Furthermore, warehousing, for example in sports shops, is made much simpler and the overall manufacturing costs for a specific range of models are reduced.

Patent specification U.S. Pat. No. 6,119,374 A describes a ski shoe with an adjusting mechanism integrated in the sole structure for changing the stiffness of the shoe sole. The sole structure in this instance is formed by an elongate, plate-type sole element, which is of a tray-shaped design and accommodates a reinforcing element. Depending on the relative position of the reinforcing element with respect to the tray-shaped sole element, it can be made extra stiff or remain as it was with the stiffness predefined by its intrinsic design. In particular, a force-induced coupling can be selectively established or released between the reinforcing element and the sole element by means of the adjusting mechanism. In other words, by establishing or releasing the connection between the tray-shaped sole element and the reinforcing element, an increased or reduced stiffness can be imparted to the sole system of the sports shoe. In the case of another embodiment, it is proposed that the reinforcing element be biased forwards, i.e. in the direction towards the shoe tip, via an adjusting means with co-operating oblique surfaces when pushed, and biased downwards when pressed, i.e. forced against the internal face of the tray-shaped sole element. This on the one hand stretches the sole element and simultaneously causes a coupling of the force between the reinforcing element and the sole element so that stiffness is imparted to the sole system. The adjusting means and the reinforcing element are fully integrated in the sole structure and are therefore not visible to the user of the sports shoe, so that its function or setting at any one time is difficult for the user of the sports shoe to see. Moreover, the range of adjustment which can be achieved in order to change the stiffness or flexibility of the ski shoe based on the proposed embodiments is either relatively small or the action of adjusting the stiffness takes place on a switched basis or in steps.

Patent specification U.S. Pat. No. 4,941,273 A describes a shoe, in particular a running shoe, with a clamping system for the sole structure in order to vary the flexibility of the sole. In this instance, an elastic strap is provided, fixedly anchored on the bottom face of the sole, which extends through the rear sole portion and deflects upwards in the heel region so that the elastic strap extends to the shoe collar. A clamping means disposed in the rear end portion of the shoe, in particular in the region of the Achilles tendon, is provided as a means of changing the tension of the elastic strap, thereby enabling the stiffness of the shoe sole to be varied. The purpose of this elastic strap is to produce a rebound effect during running with the shoe, by means of which the shoe sole is able to resume the elongate initial position after bending or elastic deformation. To this end, the rear-end portion of the sports shoe must be of a relatively stiff design to enable the respective tensioning forces expended by the elastic strap when highly tensed to be absorbed with sufficient stability. The deflection in the elastic strap has the disadvantage of causing friction and losses in tensioning force.

Patent specification DE 103 35 970 A1 describes a sports shoe with a flexible sole and outer shell in the metatarsal region, and this sports shoe has various setting options for damping behavior and sole construction, especially with regard to the support surface for the balls of the user's toes. In particular, the sole of this ski shoe is formed by leaf spring arrangements or by partial slots in the ball support surface which flex elastically in the vertical direction towards the shoe standing surface. This vertical flexibility of the foot bed can be individually varied with an adjusting means and in particular can be suppressed to a greater or lesser degree.

Patent specification DE 101 45 685 A1 discloses a shoe sole, in particular for mountain shoes, the flexibility or bending capacity of which can be individually varied. In this instance, elements are disposed one behind the other in the shoe sole, which can be pressed against one another or forced apart from one another due to the variable tension of their control cables. This enables the stiffness of the shoe sole to be individually varied because the sole becomes more or less flexible depending on the tension of the control cables. This system is designed for mountain shoes. However, the described system can not be applied to alpine ski shoes because the forces or loads acting on the sole of an alpine ski shoe are higher by a multiple.

Patent specification DE 27 23 884 A1 describes a shoe sole system for imparting stiffness to the sole of a shoe between a heel-part and a tip-part of the sole. In this instance, a plate-type support mechanism is clamped against co-operating inclined support surfaces in the heel-part and tip-part of the sole. When the plate-type support mechanism is in the assembled state, the plate-type support mechanism extends underneath the shoe camber and is thus pressed by screw means against the inclined support surfaces in the heel-part and tip-part of the sole, so that the heel-part and tip-part of the sole are forced apart from one another. As a result of this plate-type support mechanism, which can be fitted and removed as and when necessary, either a relatively more rigid or a relatively more flexible sports shoe can be obtained, thereby making it suitable for carrying out different types of sport. This is achieved due to the fact that the plate element imparting stiffness can be fitted on and removed from the shoe sole as and when necessary. The disadvantage of this is that the forces which can be transmitted from the sports shoe to a co-operating gliding sports device are only relatively low and it is not possible for the foot of a user to be fixed in a stable manner relative to a board-type sports device, in particular a ski, with the proposed design. Another disadvantage resides in the fact that the plate-type stiffening element has to be removed from the shoe sole in order to switch to a relatively more flexible shoe and carried in the user's pocket, for example, so that it can be fitted again later. This is impractical and requires a considerable amount of time for fitting, and this fitting requires a certain amount of skill on the part of the user.

SUMMARY OF THE INVENTION

The underlying objective of this invention is to propose a sports shoe, in particular a ski shoe, the stiffness or flexibility of which can be individually varied in a simple manner, the intention being to ensure that strong adjusting forces can be applied and the co-operating adjusting means is highly robust.

This objective is achieved by the invention on the basis of a sports shoe, in particular an alpine ski shoe, having adjusting means comprising at least one profiled tension element which remains essentially dimensionally stable when forces act on it and which is connected at its oppositely lying end portions to the front sole platform on the one hand and to the rear sole platform on the other hand, its middle portion extending freely between the front and the rear sole platforms, and the tension element for applying adjustable positioning forces relative to at least one sole platform in the longitudinal direction of the sole system is mounted so as to be relatively displaceable, and an individually variable tensing force can be exerted by the tension element between the front and the rear sole platform, which tensing force can be adjusted so that at least a load-induced tendency of a distance between the front and rear sole platform to become longer is counteracted or a tendential, vertical lifting of the middle portion of the sole system is induced.

One advantage of the sports shoe proposed by the invention resides in the fact that at least certain portions of the profiled tension element inside the sole system are exposed, i.e. are accessible and can be taken hold of, without increasing the risk of damage or the occurrence of wear. Due to the pedestal-type sole platforms, it is also possible to apply strong adjusting forces to the foot shell and to the sole system. In particular, the two sole platforms on the bottom face of the shoe upper act like lever elements, which enable forces to be introduced intensively into the foot shell, which usually incorporates portions made from hard plastic. Also of particular advantage is the fact that the sports shoe is supported on a flat base transmitting load via the two sole platforms spaced apart from one another in the front and rear sole portions, thereby permitting a pronounced effect to be applied to the bridge-type region lying in between via the adjusting means in terms of its flexibility or its stiffness. The stiffness created by the intrinsic design of the bottom shoe portion can be easily adjusted by means of the individually adjustable tension force of the profiled tension element within predefined limits. In particular, the specified sports shoe can be adjusted so that forces can be transmitted as directly as possible without damping to a sports device, in particular to a ski, so that a particularly effective interface is created between the user's foot and the sports device. In a surprising way that could not have been anticipated, the turning dynamics which can be achieved overall with a sports shoe of this type in combination with alpines skis can be improved because the tension element of the sports shoe rebounds to the neutral non-operating position more rapidly and more dynamically. In particular, the so-called "rebound" is assisted when the sports shoe and alpine ski is relieved of pressure on completing the turn. Alternatively, the adjusting means may also be adjusted to achieve a relatively higher travel comfort because the sole system or foot shell is relatively more flexible when forces are transmitted to the sports device accordingly—and vice versa—by the user's foot. Furthermore, because the tensioning of the tension element can be adjusted, the resultant adjusting means is such that the total weight of the sports shoe can be kept to a minimum and even though the geometric dimensions are small, high tensing forces can be applied between the sole platforms without the risk of excessive strain or damage. The sports shoe proposed by the invention can therefore be made to a relatively lightweight yet robust design, in spite of the additional adjusting means in conjunction with the at least one profiled tension element.

Also of particular advantage is another embodiment wherein the adjusting means can be re-set so that the tension element is configured to transmit thrust forces between the front and rear sole platform and a load-induced tendency of the distance between the front and rear sole platform to become longer is assisted or a tendential vertical lowering of the middle portion of the sole system is induced, because the tension element can be converted to an element transmitting thrust forces or creating a thrust effect depending on the individual wishes of the user. This results in a sports shoe which can cater for a broad range of individual requirements with only one adjusting means.

The effectiveness or degree of influence which can be had by the adjusting means is significantly more perceptible or pronounced as a result of the additional features of the sole system, in its middle portion between the front and rear sole platform, being of an essentially more flexible design compared with the stiffness of the sole system in the front and rear end portion.

Also as a result of the features of the middle portion of the sole system extending in an arching arrangement between the front and rear sole platform, the flexibility of the shoe portion next to the ground can be increased, thereby also enhancing the degree of influence of the adjusting means. In particular, a construction in the form of a clamping arch is obtained, which offers specific advantages with regard to structural design and the variability of the static properties.

As a result of the features of the rod-shaped or profiled tension element being essentially straight, the tension element may be relatively small or slim in terms of its geometric dimensions but is still capable of withstanding high tension and thrust forces without being subjected to elastic or plastic deformation or deviating movements. This also means that the overall weight can be kept as low as possible whilst nevertheless offering a robust sports shoe, in particular a ski shoe, with an adjustable stiffness.

The advantage of the embodiment of the rod-shaped tension element, in its middle portion, being disposed at a vertical distance from the bottom face of the sole system, is that a construction akin to a joiner's clamp is obtained, which enables a forceful, lever-assisted transmission of forces to the sole system or foot shell.

The embodiment in which at least one of the two sole platforms can be connected positively and/or via screw means to the bottom face of a shoe upper injected-molded from a hard plastic enables the adjusting means and tension elements to be fitted easily and reliably on the bottom face of the sports shoe. This also offers an easy way of being able to manufacture sports shoes with and without tension elements, without having to produce a separate or special shoe upper. In particular, because sole platforms are separate and then attached to the shoe bottom face, it is possible to use a single design for a shoe upper, so that sports shoes may be designed with an adjusting means and tension element on the one hand and other sports shoes may be designed without the additional setting mechanisms.

The features of anchoring and thrust bearing means for the tension element being provided respectively in the front and rear sole platform result in an extremely robust sole system which will remain functionally intact for a long time.

As a result of another embodiment in which the anchoring and thrust bearing means is of a block-type design and is positively retained in at least one co-operating recess in the front respectively rear sole platform, one and the same sole platform may be designed with or without thrust bearing means, thereby enabling sports shoes to be produced either with or without an adjusting means and tension element.

Due to the features of the tension element and the adjusting means being attached to the bottom face of the shoe upper so that they can not fall off or tear off after fitting the front and rear sole platforms, no separate assembly or fixing operations are needed for the tension element, thereby enabling short assembly times and reducing manufacturing costs.

As a result of the advantageous features of a thread arrangement being provided between the tension element and at least one of the two sole platforms, which thread arrangement is provided as a means of effecting a relative movement or transmitting force between said parts, a particularly robust and intensive transmission of forces can be generated, and the corresponding adjusting means are also intuitive in terms of their operation.

As a result of the features the thread arrangement comprising a screw body, the screw head of which can be gripped from the shoe tip end or from the heel end of the sole system, the adjusting means is accessible from outside, thereby enabling the respective settings of the adjusting means to be changed effortlessly and comfortably.

The embodiment in which the screw body is oriented in the direction of the sole longitudinal axis and is retained by means of a rotary bearing in the front or rear sole platform so that it can rotate but is axially blocked provides a rotary bearing for the screw or its screw head which is not axially displaceable so that it always remains in the same relative position with respect to the sole system and can therefore always be accessed and operated in the same way.

As a result of the feature of at least one elastically flexible spring element, for example a buffer made from an elastomeric plastic, being provided within the force-transmitting distance between the tension element and at least one sole platform, the respective pre-tensioning of the at least one tension element can be varied within a relatively broad adjustment range to suit individual wishes without problems. In particular, if the sole system or bottom shoe portion is of a relatively stiff design, a tendentially acting extra or counteracting force to the inherent natural stiffness or flexibility of the bottom shoe portion can be generated via the interconnected spring element.

The advantage of another embodiment wherein a pair of profiled tension elements is provided, extending essentially parallel and/or wherein the profiled tension elements are disposed on at least one sole platform in the two lateral peripheral portions of the sole platform is that the torsional stiffness of the sports shoe about the sole longitudinal axis can also be influenced, in particular increased.

As a result of the features of the two tension elements extending more or less in a diverging V-shape from the rear sole platform in the direction towards the front sole platform, only one adjusting means is needed to enable the effect of the force of the two tension elements to be changed jointly. Also as a result, the torsional stiffness of the sports shoe can be increased if the two tension elements are mounted so that they are essentially not able to rotate relative to the two sole platforms.

The features of the front and the rear sole platform in conjunction with the rod-shaped tension element constituting a pre-assembled unit which can be screwed to the bottom face of the shoe upper, in particular to the bottom face of the plastic shell of the alpine ski shoe, and can thus be connected to the shell body of the alpine ski shoe so that it is rigid in movement make the operation of fitting a sole system with extra features to the bottom face of the shoe upper uncomplicated and quick.

The embodiment wherein the anchoring and thrust bearing means is provided in the form of a block-type or plate-type thread body injected into at least one sole platform or positively inserted therein results in a sole platform which is capable of absorbing high tension and thrust forces, thereby permitting a corresponding deformation or pre-tensioning, even in the case of relatively stiff foot shells.

An adjustment force between the two sole platforms that is easy to change is achieved as a result of the embodiment wherein the profiled tension element has a thread arrangement in at least one end portion to provide a relatively adjustable or force-coupled connection to at least one of the two sole platforms, and this adjustment force can also be easily and permanently switched between a tension or a thrust force without the need for additional locking or blocking mechanisms for this purpose. In particular, the result is a multifunctional adjusting means which is robust but mechanically simple and inexpensive to make.

As a result of the features of at least one end portion of the profiled tension element having a slotted, Phillips, or socket head screw head, standard, commonly available tools or simple objects may be used to change the effect of the tension element, for example a coin or similar.

The features of the rod-shaped tension element having at least one abutment surface or at least one flange-type projection to provide an axially non-displaceable fixture relative to one of the two sole platforms provide a simple way of enabling both a tensing and a thrust action to be effected between the two sole platforms.

The features of the rod-shaped tension element being provided with a rotary bearing, for example a receiving bore sunk into a sole platform or a retaining mechanism with an essentially U-shaped cross-section on one sole platform, and this rotary bearing providing a rotatable but radially and axially secured bearing for the tension element with respect to at least one of the two sole platforms result in an inexpensive, robust and durably reliable bearing or retaining system for the tension element relative to the sole platforms.

The advantage of the embodiment of the adjusting means having at least one clamping lock which has oppositely running thread portions, and the clamping lock being connected via a first tension element and a first thread portion to the front sole platform and via another tension element and another thread portion to the rear sole platform is that the adjusting means is readily accessible and can be easily reached because it is centrally positioned as it were in the region of the gap and, being approximately centrally disposed with respect to the sole system, the gap also provides sufficient room to maneuver in order to adjust the sole stiffness quickly and comfortably. Moreover, the way in which the adjusting means operates is intuitive and obvious.

The features of the adjusting means having a threaded spindle arrangement, which has a left-hand thread on the one hand and a right-hand thread on the other hand, and which is connected to one of the two sole platforms respectively in the distal end portions by means of co-operating threaded bores also make setting times short and the respective setting can be changed effortlessly. Furthermore, the number of components needed to change the variable sole stiffness of the sports shoe is also kept particularly low.

Also of particular advantage is the embodiment wherein a force-transmitting extension in the front and/or rear sole platform can be positioned so that it is disposed at a movable distance from a thrust bearing or stop surface or from an elastomeric body or spring element in the front and/or rear sole platform at which it is free of force, because these features also enable the inherent stiffness of the sports shoe or the flexibility predefined by the structural design of the sole to be adjusted. In particular, the adjusting means can be used to set an inactive state in which the characteristics of the sole system are not dependent on the action of the at least one tension element. In other words, the at least one tension element can be switched so that it is essentially inactive, in which case the tension element has no effect on the flexibility behavior.

An embodiment wherein the profiled tension element is dimensionally stable transversely to its longitudinal extension so that it is able to transmit a thrust force of at least 10 N between the front and rear sole platform is also of advantage because a sufficiently high thrust force can be applied between the two sole platforms in order to produce a perceptible change in the behavior or performance of the sports shoe.

Finally, an embodiment wherein the profiled tension element has carbon fiber composite materials at least within the major part-portion of its length is of advantage because the overall weight of the sports shoe is barely increased by the co-operating tension element but strong forces can be absorbed and transmitted nevertheless. A tension element of this type is also particularly robust and such a tension element will also remain visually attractive, even after long periods of relatively rough use, because impacts with or collisions on the tension element which is relatively unprotected on the bottom face of the sole system will not cause or will cause barely any plastic deformations or notches in the surface of the tension element.

BRIEF DESCRIPTION OF THE DRAWINGS

The invention will be explained in more detail below with reference to examples of embodiments illustrated in the appended drawings. Of these.

DETAILED DESCRIPTION OF PREFERRED EMBODIMENTS

Figure 1:
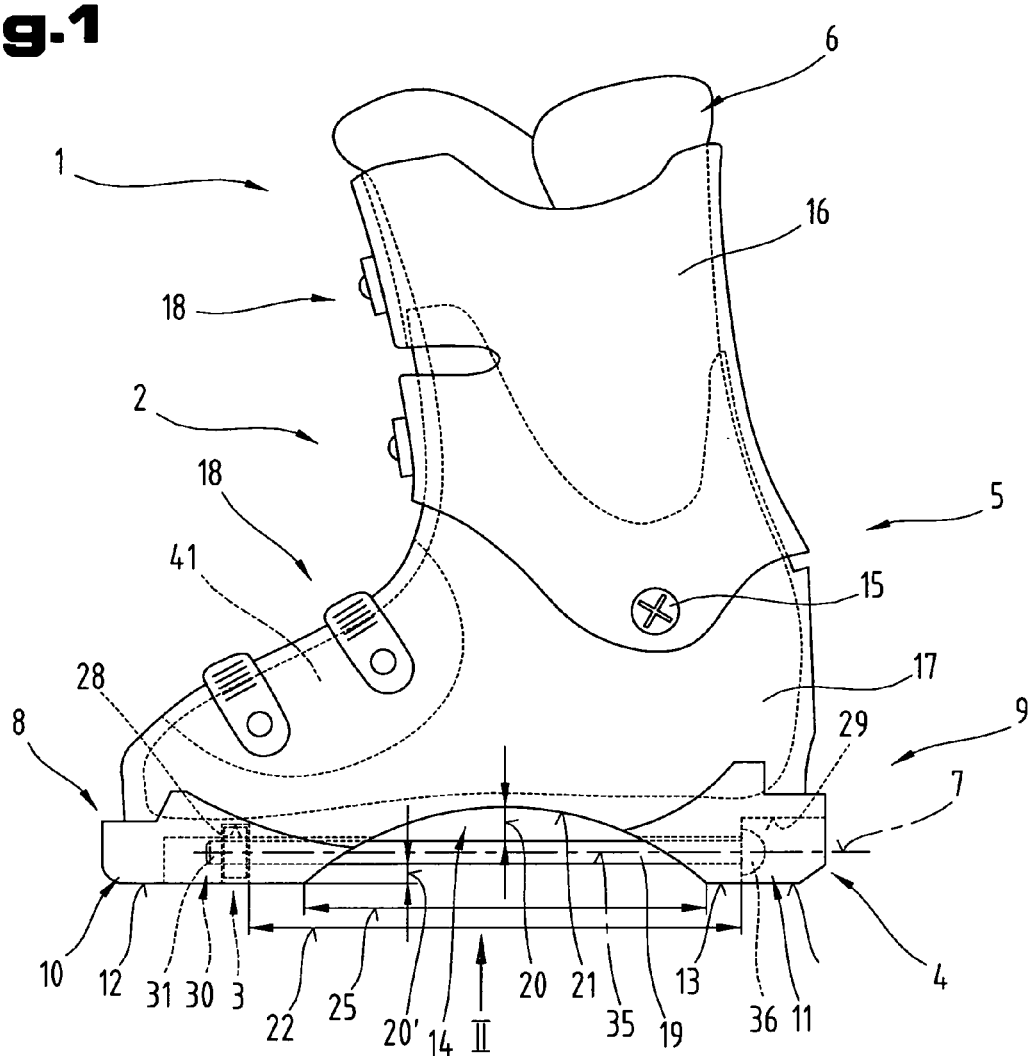
FIG. 1 is a simplified, schematic side view showing a sports shoe, in particular an alpine ski shoe, with a first embodiment of an adjusting means for changing the flexibility or stiffness of the foot shell or sole system.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

Figure 2:
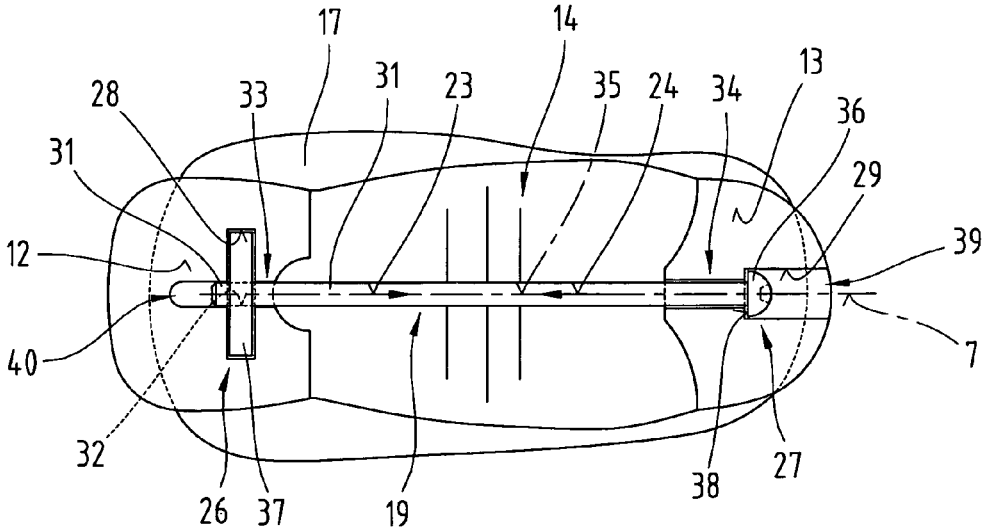
FIG. 2 is a view of the sports shoe illustrated in FIG. 1 from underneath, in particular a view in the direction of arrow II indicated in FIG. 1.

FIGS. 1 and 2 illustrate an embodiment of a sports shoe 1, in particular in the form of an alpine ski shoe 2. An adjusting means 3 is provided on this sports shoe 1 for changing or individually adjusting the stiffness or flexibility of the sports shoe 1 as and when necessary. In particular, the stiffness of a sole system 4 of the sports shoe 1 can be influenced by means of the adjusting means 3.

The manually operated adjusting means 3 described in detail below is preferably used for alpine ski shoes 2. However, in a similar embodiment, the adjusting means 3 could also be used with ski shoes 2 of a different kind, in particular touring ski shoes, snowboard shoes or cross-country ski shoes.

The sports shoe 1 can essentially be sub-divided into a shoe upper 5 and the above-mentioned sole system 4, and the sole system 4 is disposed on the bottom face of the shoe upper 5 in a manner known per se. The shoe upper 5 is of a shell-type or cage-type design and is made from plastic, leather and/or textiles. Above all, ski shoes 2 of the generic type have a shoe upper 5 with a plurality of reinforcing portions made from plastic, in particular hard plastic, to enable forces which have to be transmitted from a user's foot to a sports device to be transmitted as directly as possible and without delay to a board-type gliding device, in particular to a ski.

An inner shoe 6 is at least partially accommodated in the shoe upper 5. The purpose of this inner shoe 6 is to embed the foot of a user comfortably and the inner shoe 6 is designed to prevent any unpleased pressure or friction points on the user's foot as far as possible. It is preferable if the inner shoe 6 can be removed from the shoe upper 5 when necessary, in order to ensure better drying of the inner shoe 6 or to make walking more comfortable with the inner shoe 6. Alternatively or in combination, an inner lining may also be provided in the shoe upper 5, which is non-detachably connected to the shoe upper 5.

By reference to a sole longitudinal axis 7, the sole system 4 has coupling means 8, 9 disposed respectively in the oppositely lying end portions—in a manner known per se—which are designed to be connected to a front and rear coupling element of a ski binding and which can be released from such a ski binding or co-operating ski again when necessary. These coupling means 8, 9 are preferably provided in the form of an extension of the shoe tip and of the shoe heel but may also be provided in the form of indentations, undercuts or cutouts designed for coupling with a co-operating ski binding.

The sole system 4 comprises a front and rear sole platform 10, 11, and the front sole platform 10 is disposed in the front shoe portion extending more or less across the part-portion between the shoe tip and the support area for the ball of a user's foot. The rear sole platform 11 essentially forms a heel-end platform of the sports shoe 1 and extends approximately from the rear end of the sports shoe 1 as far as the support zone of the heel of a user's foot.

The bottom faces of the front and rear sole platform 10, 11 form a front shoe support surface 12 and a shoe support surface 13 spaced at a distance apart from it. The front and rear shoe support surfaces 12, 13 are approximately the size of a hand surface—excluding the finger surfaces. In particular, the front and the rear sole platform 10, 11 each have a support surface 12, 13 of 30 to 70 $cm^2$, preferably approximately 50 $cm^2$. Between the front and rear sole platform 10, 11, the sole system 4 has a gap 14. By reference to the sole longitudinal axis 7, this gap 14 extends essentially between the ball of the toes and the ball of the heel of a user's foot inserted in the sports shoe 1, i.e. essentially underneath the arch of a user's foot. In other words, this gap 14 between the front and rear sole platform 10, 11 is disposed within a sole part-portion which, by reference to a user's foot, extends essentially from the metatarsal portion, i.e. from the middle foot bone, towards the rear more or less as far as the ankle or ankle joint. An articulated joint 15 or an elastic deformation zone is preferably provided on the sports shoe 1 in this ankle or ankle joint portion.

In particular, in a manner known per se in the case of ski shoes 2, an articulated joint 15 is provided, which is designed to provide an articulated link between a top shoe cuff 16 and a foot shell 17 accommodating a user's foot, and this articulated joints axis is disposed essentially at the point of the ankle joint of the foot. The gap 14 in the middle portion of the sole system 4 makes the foot shell 17 relatively more flexible in its middle portion than it would be if the sole system 4 extended in a plate-type arrangement between the shoe tip and the shoe heel. The gap 14 in the sole system 4 may have an arcuate contour as viewed in section—as schematically illustrated—so that the foot shell 17 extends in a bridge-type arrangement between the shoe tip region and the heel-end heel-part and is therefore supported on the front and rear sole platform 10, 11 so that it transmits load.

The sole system 4 with the two sole platforms 10, 11 may form an integral unit with the foot shell 17. Especially if the foot shell 17 is made by a plastic injection molding process, the sole platforms 10, 11 may be injection molded in a single piece with the foot shell 17 and an appropriate gap 14 may be imparted to the middle portion of the sole system 4 at the same time.

In order to ensure a firm seat for the foot in the sports shoe 1, strap and clamping means 18 of a type known from the prior art are provided in or on the sports shoe 1, such as lever buckles, cable pull systems or similar, for example. Strap and clamping means 18 of this type enable the opening width and receiving volume of the sports shoe 1 or inner shoe 6 to be made bigger and smaller as necessary.

The adjusting means 3 for changing the stiffness or flexibility of the sole system 4 and the foot shell 17 joined to it comprises at least one profiled tension element 19, which remains largely dimensionally stable under the effect of the forces which prevail under standard conditions of usage. In the embodiment illustrated as an example, a bar-shaped or rod-shaped tension element 19 is provided, the tensile strength of which is such that its length remains essentially constant when subjected to a tensile strain of up to 10 N. This tension element 19 also has a certain degree of shearing strength. This means that the transverse stiffness of the tension element 19 is such that it experiences no deviation and does not deform in the direction extending transversely to the sole longitudinal axis 7 under the loads which occur during normal use. In particular, the profiled tension element 19 is dimensionally stable to the degree that it does not flex and is not essentially deformed transversely to its longitudinal extension when a thrust force of 10 N is transmitted between the front and rear sole platform 10, 11. It is also of practical advantage if the tension element 19 also remains essentially dimensionally stable in the central part-portion inside the gap 14 in the direction extending transversely to its longitudinal axis under the effect of a thrust force of approximately 10 N and does not experience any visibly perceptible give or flexing under such a shearing force. The tension element 19 is preferably designed so that it is capable of transmitting a thrust force of more than 10 N between the front and rear sole platform 10, 11.

In the embodiment illustrated as an example, a rod-shaped or profiled tension element 19 is provided, extending essentially congruently with the sole longitudinal axis 7. In particular, this tension element 19 is disposed longitudinally down the center and thus couples the front sole platform 10 with the rear sole platform 11, and it preferably extends across the major part of the length of the gap 14 where it lies free as a result. The fact that the tension element 19 extends freely in the region of the gap 14 means that the tension element 19 does not touch and is not in contact with the shoe bottom face in the centre portion, at least in certain regions. In particular, the tension element 19 is disposed at least within a part-portion of the gap 14 at a distance 20 from the bottom face 21 of the sole system 4. Especially in the region underneath the arch of a user's foot, the tension element 19 extends at a distance 20 of approximately 3 to 15 mm, preferably approximately 10 mm, from the bottom face 21 of the sole system 4. If the gap 14 is of a generally arcuate design in longitudinal section, this distance 20 may vary between 0 and approximately 25 mm, in which case the maximum spacing will depend on the height of the sole platform 10, 11, the maximum height of the gap 14 and the cross-sectional height of the tension element 19.

This profiled tension element 19 is connected at its oppositely lying or distal end portions to the front sole platform 10 on the one hand and the rear sole platform 11 on the other hand so that at least a tensing force can be applied between the sole platforms 10, 11, causing the two sole platforms 10, 11 to move closer to one another. In particular, the tension element 19 is able to generate a vice-type or joiner's clamp-type connection so that the two sole platforms 10, 11 are forced or pushed in the direction towards the sole center or in the direction towards the gap 14 depending on the setting of the adjusting means 3. This tensing force or drawing-in force between the sole platforms 10, 11 causes a stiffening of the sole system 4 in response to loads directed vertically downwards, such as those to which the sole system 4 is normally subjected during use. In particular, the tensing forces which can be applied via the tension element 19 cause a tendential drawing together of the sole platforms 10, 11 and a tendential or slight lifting of the middle portion of the sole system 4 upwards in the vertical direction and/or at least cause the distance between the sole platforms 10, 11 to remain constant so that the sole system 4 and foot shell 17 are stiffer or less flexible in response to loads directed vertically downwards. Accordingly, the tension element 19 acts as a kind of drawbar between the support bases or sole platforms 10, 111 of the sports shoe 1. The specified sole system 4 can therefore be likened to a bridge construction, and the at least one tension element 19 acts as a variably adjustable, statically defined drawbar between the two sole platforms 10, 11.

The tension element 19 on the bottom face of the sports shoe 1 acting like a clamp is at least partially integrated in the sole system 4 because at least the end portions of the tension element 19 are respectively connected to the sole platforms 10, 11 and anchored in these shoe portions. The essential factor is that an effective length or a clamping length 22 of the tension element 19 can be individually varied so that it acts as or constitutes the adjusting means 3 for the individually variable tensing forces or clamping action between the two sole platforms 10, 11. As a result of the joiner's clamp-type, variable clamping length 22 of the tension element 19, an individually variable tensing force can be generated between the front and the rear sole platform 10, 11—as indicated by arrows 23, 24. The tensing forces indicated by arrows 23, 24 oppose a load-induced tendential increase in a distance 25 between the front and rear sole platform 10, 11. Via at least one adjusting means 3 for the tension element 19 or for its anchoring element, therefore, an individually variable tensing force can be set in the direction of arrows 23, 24. The tensing forces 23, 24 thus act in the direction towards the sole center or in the direction towards the center of the sole system 4, so that a vertical lifting of the middle or central portion of the sole system 4 results or is assisted. De facto, such a lifting of the central sole portions or a movement of the sole platforms 10, 11 towards one another does not usually take place or does so only slightly, and instead it is primarily a stiffening of the sole system 4 and foot shell 17 that is achieved or produced due to the variable tensing force indicated by arrows 23, 24. Any reduction which might occur in a distance 25 between the sole platforms 10, 11 compared with the no-load state will be at most approximately 5 mm, preferably approximately 3 mm. As a result, the thrust forces which must be applied by a ski binding, in particular its thrust spring system, to the shoe tip and to the shoe heel are not significantly impaired or altered. Limiting the maximum degree to which the distance 25 between the sole platforms 10, 11 can be reduced and limiting the maximum ability of the sole length to shorten to approximately 5 mm is also of practical advantage in terms of ensuring that the correct functioning of a safety ski binding is not impaired when the tension element 19 is tensed to a maximum.

In the embodiment illustrated as an example in FIGS. 1 and 2, the two sole platforms 10, 11 are fixedly joined to the foot shell 17 and in particular are integrally joined to its bottom face 21. This results in a relatively inexpensive shoe structure and relatively high tensing forces also can be applied by the tension element 19, in particular up to 300 N, without any risk of the of the sole platforms 10, 11 or sole system 4 being damaged or breaking. Furthermore, this means that relatively flexible foot shells 17 or sole systems 4 can be made significantly stiffer if the adjusting means 3 is adjusted so that relatively high pre-tensioning or tensing forces act as indicated by arrows 23, 24.

To provide the most stable bearing or anchoring possible for the clamp-type tension element 19, at least one anchoring and thrust bearing means 26, 27 is provided in the front and rear sole platform 10, 11 respectively for the oppositely lying end portions of the tension element 19. These anchoring and thrust bearing means 26, 27 are designed so that they are able to withstand the maximum tensing forces which can be applied via the tension element 19 as indicated by arrows 23, 24 without resulting in problems or breaking. In one advantageous embodiment, these anchoring and thrust bearing means 26, 27 have at least one recess 28, 29 in the front and rear sole platform 10, 11. These recesses 28, 29 may be worked into the sole platforms 10, 11 starting from the bottom face or starting from the support surfaces 12, 13 of the sports shoe 1. Through these recesses 28, 29, which are open at one end, the adjusting means 3 together with the tension element 19 can be at least partially inserted in the sole platforms 10, 11 and partially integrated in the sole system 4 so that they are thus retained on the sole system 4. The recesses 28, 29, which are therefore accessible from the bottom face of the sole system 4, make for simple fitting of and access to the adjusting means 3 as well as the tension element 19.

The main thing is that when the oppositely lying end portions of the tension element 19 have been fitted in the respective co-operating recesses 28, 29, the tension element 19 and its adjusting means 3 are secured to the bottom face of the shoe upper 5, in particular to the sole system 4, so that they can not tear out or fall out.

In order to apply appropriate tensing forces—indicated by arrows 23, 24—between the tension element 19 and the two sole platforms 10, 11, it is preferable to provide at least one thread arrangement 30, the purpose of which is to permit relative movement and a trans-mission of force between the profiled tension element 19 and the two sole platforms 10, 11 as necessary. In particular, a thread arrangement 30 is provided in at least one end portion of the tension element 19, thereby enabling a tensing force indicated by arrows 23, 24 to be increased or reduced to suit individual wishes or requirements. In other words, the profiled tension element 19 has a thread arrangement 30 in at least one of its end portions for producing a relatively adjustable connection to at least one of the two sole platforms 10, 11. This thread arrangement 30 comprises at least one screw body 31, which is mounted inside a threaded bore 32 so that it can be adjusted in the direction of the sole longitudinal axis 7. The screw body 31 is preferably formed by a thread portion in at least one end portion of the bolt-type tension element 19, as may be seen from FIG. 2. Such a thread arrangement 30 provides an easy way of enabling the tension element 19 to be placed under tension and a simple way of enabling variable tensing forces to be transmitted between the front and the rear sole platforms 10, 11. Especially if the tension element 19 is provided in the form of a screw extending in the direction of the sole longitudinal axis 7, the tension element 19 is mounted so that it can be moved in rotation both in the front and in the rear sole platform 10, 11. In particular, a rotary bearing 33, 34 is provided respectively in the front and rear sole platform 10, 11, which enables the tension element 19 to be turned about a rotation axis 35 oriented parallel with the sole longitudinal axis 7.

The tension element 19 or a screw head 36 of the screw body 31 can be accessed and taken hold of from the shoe tip and/or—as is the case in the embodiment illustrated as an example in FIGS. 1 and 2—from the heel end of the sole system 4. By means of the at least one screw head 36 co-operating with at least one end face of the sole system 4, which screw head 36 can be accessed and operated by the user of the sports shoe 1 from at least one end face of the sports shoe 1, the tension element 19 can be displaced in a rotating movement about its rotation axis 35, thereby changing the pre-tensioning of the tension element 19. This is achieved in a simple manner by means of the thread arrangement 30, which causes the distance 25 between the sole platforms 10, 11 to become shorter but optionally also bigger, or at least has a tendency to strive to achieve this effect. The distance between the two sole platforms 10, 11 can therefore be easily made shorter or longer by means of the thread arrangement 30.

In the embodiment illustrated as an example, the threaded bore 32 for the screw body 31 or a screw thread at the end portion of the tension element 19 is disposed in a thrust bearing 37 extending transversely to the sole longitudinal axis 7. This thrust bearing 37 is inserted in a matching recess 28 in the front sole platform 10. The rod-shaped or screw-shaped tension element 19 also has at least one support surface 38, which may be formed by the bottom face of the screw head 36, for example. However, this support surface 38 may also be formed by a radially projecting, flange-type projection on the bolt-type tension element 19. The main thing is that the at least one support surface 38 causes at least a unidirectional, preferably bidirectional fixing of the tension element 19. In the embodiment illustrated as an example in FIGS. 1 and 2, the support surface 38 is provided on the screw head 36 and prevents any axial shifting of the tension element 19 in the direction towards the front sole platform 10 without generating a tensing force in the direction indicated by arrow 24. In particular, the screw head 36 is supported on a complementary surface in the recess 29 so that the rear sole platform 11 is forced in the direction towards the front sole platform 10 when the tension element 19 is set to apply a tensing action.

As may be seen in particular from FIG. 2, a rotary bearing 34 is provided for the rod-shaped tension element 19, which is formed by a receiving bore 31 in the rear sole platform 11 with at least one step as viewed in cross-section. Alternatively or in combination, the rotary bearing 33, 34 may also be provided in the form of a retaining mechanism 40 with a U-shaped cross-section disposed on at least one sole platform 10, 11 and co-operating with the bolt-shaped or screw-shaped tension element 19, thereby providing a rotary bearing 33, 34 for the tension element 19. The main thing is that the rotary bearing 33, 34 for the bolt-shaped or screw-shaped tension element 19 forms a radial retaining mechanism and axially secures the tension element 19 and at least one of the two sole platforms 10, 11.

The rod-shaped tension element 19 is preferably of a largely straight design. The tension element 19 may optionally also be of a bridge-type design, in which case it will has an essentially constant contour, for example arching upwards in an arc like the gap 14 between the two sole platforms 10, 11. It is of advantage if the bottom face of the tension element 19 is disposed at a distance 20' above the shoe support surfaces 12, 13. This avoids and prevents any contact of the tension element 19, which usually has a hard surface, with the ground underneath, for example with a ski binding or a ground surface. The distance 20' is at least 3 mm, preferably approximately 5 to 15 mm. Amongst other things, this makes walking or climbing and such like easier.

In one advantageous embodiment, the profiled tension element 19 has load- and force-transmitting carbon fiber composite materials at least within the major part-portion of its length. The distal end portions, in particular thread portions, of the tension element 19 may also be made of metal, in particular lightweight metal. For example, it is of advantage to provide a screw-type tension element 19 which is surrounded by a hollow cylindrical sleeve, at least in the region of the gap 14, or is surrounded by partial cladding made from carbon fiber composite materials, at least in certain portions.

In one advantageous embodiment, the sole system 4 and the foot shell 17 are of a significantly more flexible design in their middle portion compared with the stiffness of the sole system 4 and foot shell 17 in the front and rear end portion. This can be achieved by means of the gap 14 and/or by a foot shell 17 that is relatively flexible or more readily bendable in the metatarsal portion. For example, the foot shell 17 may have at least one elastically deformable zone 41 in order to produce a certain articulating movement or flexibility by reference to an axis extending transversely to the sole longitudinal axis 7, which is preferably disposed in the instep region, as indicated by broken lines. Alternatively or in combination, the foot shell 17 may have a plurality of weakened portions or orifices in the upper instep region and in the longitudinal middle portion, i.e. at the side, bottom and/or top. This will impart a certain degree of flexibility to the foot shell 17 if the inner sole of the sports shoe 1 or the foot shell 17 is subjected to correspondingly high vertical loads. In particular, a certain kinking of the foot shell 17 can be permitted or enabled if the gap 14 and/or the elastic zone 41 or some other features designed to reduce flexibility permit a certain degree of flexibility or flexing of the foot shell 17 together with the sole system 4. This bending ability or transverse deformability of the foot shell 17 is also helped by the fact that the foot shell 17 is supported in a load-bearing capacity on the ground underneath by only the two sole platforms 10, 11 in the front and rear end portion but is free in the middle portion. This flexibility of the foot shell 17 and of the sole system 4 inherent in the design can be reduced or increased to suit individual wishes via the adjusting means 3 and tension element 19. Especially when the sports shoe 1, in particular a ski shoe 2, is being used for its intended purpose inserted in a ski binding and thus coupled with a ski, the predefined flexibility of the ski shoe 2 inherent in the design can be countered or at least reduced by the adjusting means 3, thereby enabling a performance-oriented use and undelayed transmission of force to the sports device. For situations where a comfort-oriented travel mode is required or for walking over distances relatively more comfortably, the adjusting means 3 can then be adjusted so that a relatively higher flexibility is imparted to the foot shell 17 or sole system 4.

Figure 3:
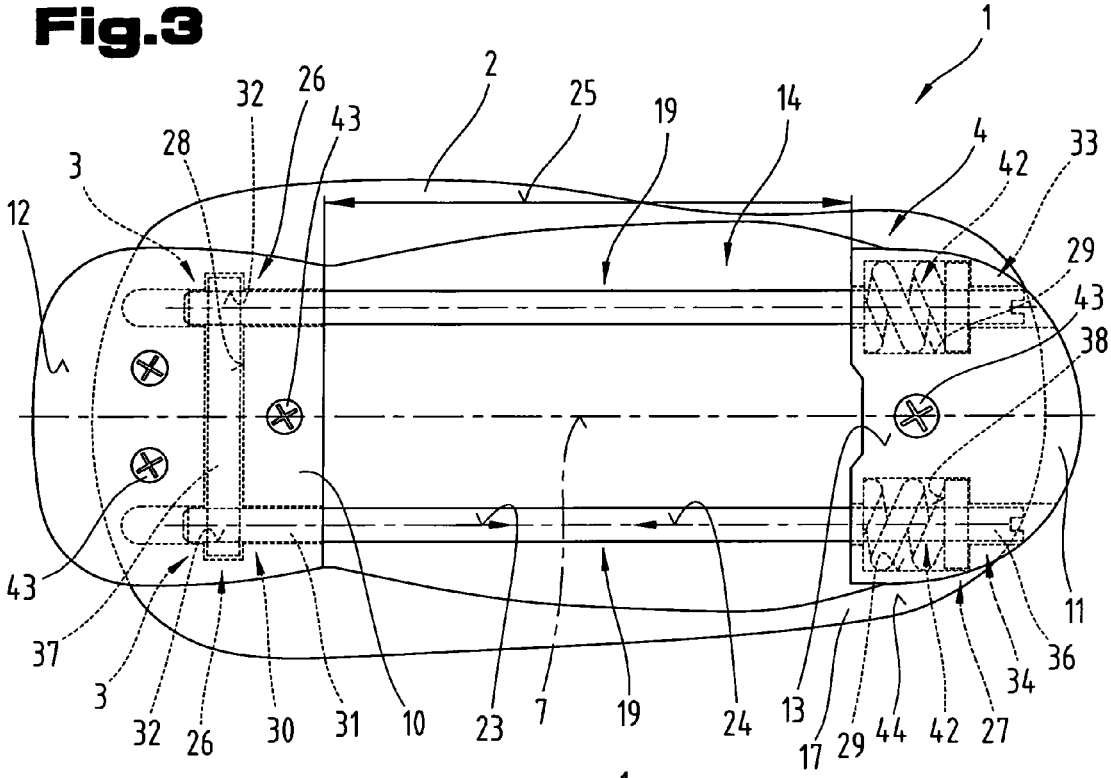
FIG. 3 is a view from underneath illustrating a different embodiment for individually changing the stiffness or flexibility of a sports shoe.

In FIG. 3 illustrates another example of an embodiment of a sole system 4 for a sports shoe 1, in particular a ski shoe 2. In this instance, there are two tension elements 19 essentially acting in parallel, and their tensioning action or initial tension can be adjusted independently of one another. In particular, each tension element 19 is provided with a separate adjusting means 3 which acts independently of the other respective adjusting means 3 and each of which can be adjusted independently of one another. This pair of profiled tension elements 19 extending essentially parallel is anchored in an elastically flexible arrangement in a first end portion, in particular in the front sole platform 10, and in the oppositely lying end portion is mounted so as to be relatively displaceable when force is actively applied—in particular relative to the rear sole platform 11. To this end, the tension element 19 can be fixed in the respective desired relative position in which a tensing force is being exerted between the sole platforms 10, 11. By preference, the two profiled tension elements 19 cooperate respectively with the two lateral edge portions of the sole platforms 10, 11. In particular, the two tension elements 19 extend on either side of the sole longitudinal axis 7 if the sole system 4 is viewed from underneath—as illustrated in FIG. 3.

In one advantageous embodiment, at least one elastically flexible spring element 42 is provided, which is disposed within the distance across which the tension element 19 transmit force, in particular between the tension element 19 and at least one sole platform 10, 11. In the embodiment illustrated as an example, a spring element 42 is provided for each of the two tension elements 19, for example a helical spring or a buffer made from an elastomeric plastic. The tension element 19 preferably extends centrally through this elastically flexible and automatically rebounding sleeve-type or helical-type spring element 42. The spring element 42 is preferably supported in a load-transmitting arrangement in a corresponding recess 29 of the sole platform 11 and is at least partially accommodated in it.

In the case of the embodiment illustrated in FIG. 3, therefore, a resilient and elastically flexible anchoring or thrust bearing means 27 is provided for the tension element 19, which results in a relatively higher or lower flexibility of the sole system 4 when loads are acting perpendicular to the shoe support surface 12, 13, depending on the initial setting of the permanently acting tensing force—indicated by arrows 23, 24. In the situation where there is a sufficiently high load between the shoe support surfaces 12, 13 and the support surface for the user's foot, the resilient and elastically flexible anchoring and thrust bearing means 27, which may be integrated in the rear sole platform 11, for example, therefore serves as a guide extending in the direction of the sole longitudinal axis 7 or an elastically flexible length compensating means for the relevant end of the at least one tension element 19 cooperating with the elastic anchoring and thrust bearing means 27. The tension element 19 may therefore be of a totally non-stretching design when exposed to forces but an elastic flexibility or damping action is nevertheless imparted within the sole system 4, which will remain constant and reproducible for a long time.

A structurally separate, i.e. separately made, sole platform 11 is preferably provided, the top face of which remote from the shoe support surface 13 is partially cut out, making it possible to provide the recess 29 for accommodating the spring element 42 and at least a part-portion of the tension element 19. In particular, the rear sole platform 11 has a receiving bore with a first diameter for accommodating the cylindrical tension element 19 and a second bore with a relatively larger diameter for accommodating the sleeve-type or helical-type spring element 42. At least the rear sole platform 10 with the spring elements 42 and part-portions of the tension element 19 inserted in it can be connected, positively and/or by screw means 43, to a bottom face 44 of the shoe upper 4, made at least partially from hard plastic, in particular to a bottom face 44 of the foot shell 17. Once the sole platform 11 has been attached to the bottom face 44 of the shoe upper 5, the sole platform 11 is fixed so that it moves rigidly with respect to the foot shell 17. The positive retaining system, which also constitutes a rotatable bearing for the at least one tension element 19, simultaneously fixes the tension element 19 or tension elements 19 inside the sole system 4 so that it or they can not fall out.

The front and the rear sole platform 10, 11 together with the at least one rod-shaped tension element 19 preferably form a preassembled unit. This preassembled unit can be connected to the bottom face 44 of the shoe upper 5 or the foot shell 17 in a separate assembly step. The unit comprising the two sole platforms 10, 11 and the tension element(s) 19 is preferably screwed by several screw means 43 to the bottom face 44 of the foot shell 17 of an alpine ski shoe 2 made from plastic. Once the sole platforms 10, 11 have been fitted, they, together with the tension element 19 and the co-operating adjusting means 13 are connected to the shoe upper 5 so that they can not be torn off.

In a similar manner, a thrust bearing 37 with two threaded bores 32 is anchored in a recess 28 of the front sole platform 10. In particular, a screw thrust bearing 37 of this type is simply inserted in the recess 28 of the sole platform 10 and when the front sole platform 10 has been fitted by means of at least one screw means 43, a non-releasable and reliable bearing of the front end portion of the at least one tension element 19 is guaranteed. In particular, the anchoring and thrust bearing means 26, 27 for the tension element 19 may be provided in the form of a block-type or plate-type threaded body, which is injected into or positively inserted in at least one sole platform 10, 11.

In the case of the embodiment illustrated in FIG. 3, the primary tensing action of the tension element 19 can also be converted into a thrust action. In particular, it is possible, via the adjusting means 3, to adjust the tension elements 19, which are of a tension-resistant and shear-resistant design, as a function of the setting of the adjusting means 3 so that the tension elements 19 constantly tend to force the sole platforms 10, 11 apart from one another and stretch the sole system 4. This is easily achieved due to the fact that the adjusting means 3, in particular the thread arrangement 30, is moved in the opposite direction so that forces are exerted on the oppositely lying anchoring and thrust bearing means 26, 27, which try to increase the distance 25 between the sole platforms 10, 11 and the thrust forces place the sole system 4 under a mechanical pre-tensioning to the degree that a tendency towards an increase exists or is assisted.

Whilst the embodiment illustrated in FIG. 3 has the at least one tension element 19 provided with a spring element 42 that is elastically flexible in the tensing direction—indicated by arrows 23, 24—an alternative embodiment has the at least one tension element 19 in the form of a thrust transmitting or thrust generating means, in which case thrust forces are transmitted directly or rigidly between the two sole platforms 10, 11, i.e. undamped.

The tensing force of the tension element 19 or the two tension elements 19 acting in parallel may be individually varied individually via the adjusting means 3 within a range of −50 N to 50 N, preferably at least 0 to approximately 30 N. In particular, the tensing force of the at least one tension element 19 can also be stopped or eliminated via the adjusting means 3 so that the intrinsic flexibility or stiffness of the sole system 4 or foot shell 17 prevails.

Figure 4:
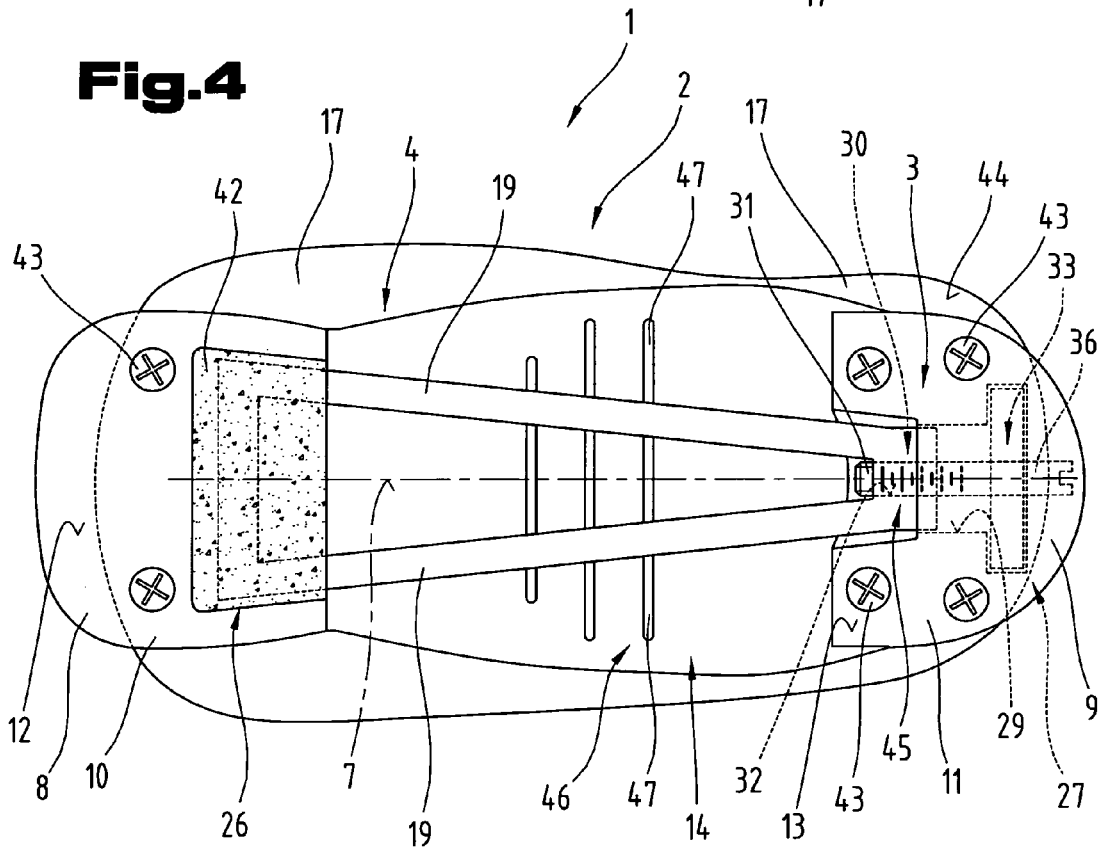
FIG. 4 illustrates another embodiment with tension elements extending in a V-shape for changing the sole or shell stiffness.

FIG. 4 illustrates another embodiment of an adjusting means 3 for individually adjusting the stiffness or flexibility of the sole system 4 of a sports shoe 1, in particular a ski shoe 2, by way of example.

In this instance, two tension elements 19 functionally connected in parallel are provided and the two tension elements 19 diverge from one another approximately in a V-shape from the rear sole platform 11 in the direction towards the front sole platform 10.

One of the two anchoring and thrust bearing means 26, 27, in particular the anchoring and thrust bearing means 26 co-operating with the front sole platform 10, is provided in the form of an elastomeric spring element 42 injected into the front sole platform 10 or positively inserted in it. This elastomeric spring element 42 is simultaneously used as a means of retaining, in particular anchoring or integrating, the end portions of the two tension elements 19 facing the front sole platform 10, as indicated by broken lines. This elastomeric spring element 42, which simultaneously defines the anchoring and thrust bearing means 26, enables a damped transmission of tensing and thrust forces between the sole platform 10 and the two tension elements 19.

In one particular embodiment, the spring element 42 simultaneously fulfils the function of a so called "grip" of the sports shoe 1 which increases the shoe support surface 12 or anti-slip support for the sole system 4. In particular, the slip behavior of the sole system 4 made from hard plastic can be significantly reduced by means of an elastomeric spring element 42 terminating flush with the bottom face of the sole platform 10 or alternatively with an elastomeric spring element 42 standing slightly proud of the bottom face.

Close to the rear sole platform 11, the two tension elements 19 run together to form a cone-type end portion. This common end portion is actively connected to the adjusting means 3, which preferably has a thread arrangement 30 for individually adjusting tensing or thrust forces between the sole platforms 10, 11. The cone-type end portion of the two tension elements 19 is able to effect a relative movement in the direction of the sole longitudinal axis 7, guided in a co-operating recess 29 of the sole platform 11. By means of a scale 45 disposed in the relatively displaceable portion between the at least one tension element 19 and at least one of the sole platforms 10, 11, the user of the sports shoe 1 can adjust the respective setting of the adjusting means 3, in particular the prevailing thrust or tensing force. If the adjusting means 3 acts on a spring element 42—as is the case with the embodiment illustrated in FIG. 3 or FIG. 5 for example—a pointer element or some other marker may be provided in the relatively displaceable portion, which indicates the respective thrust or tensing force of the at least one tension element 19 on a stationary scale 45. It would naturally also be possible to opt for a structurally reverse arrangement of the pointer and scale 45. Depending on the load or pre-tensioning of the spring element 42, different values or relative positions are displayed on the scale 45. In particular, the force applied by the spring element 42 to the at least one tension element 19 and consequently to the sole platforms 10, 11 is displayed on a display means, for example in the form of a scale 45.

In order to provide a simple and reliable mounting for the adjusting means 3 in conjunction with the two tension elements 19, the two sole platforms 10, 11 mechanically connected to these parts are preferably fitted to the bottom face 44 of the foot shell 17 via screw means 43.

On the bottom face 44 of the foot shell 17 or sole system 4, in particular in the region of the gap 14, additional weakening means 46 may be provided, by means of which the intrinsic transverse stiffness of the sole system 4 or foot shell 17 can be additionally reduced or lowered. This weakening means 46 may be provided in the form of at least one cut 47 or orifice in the sole system 4 or in the foot shell 17.

Figure 5:
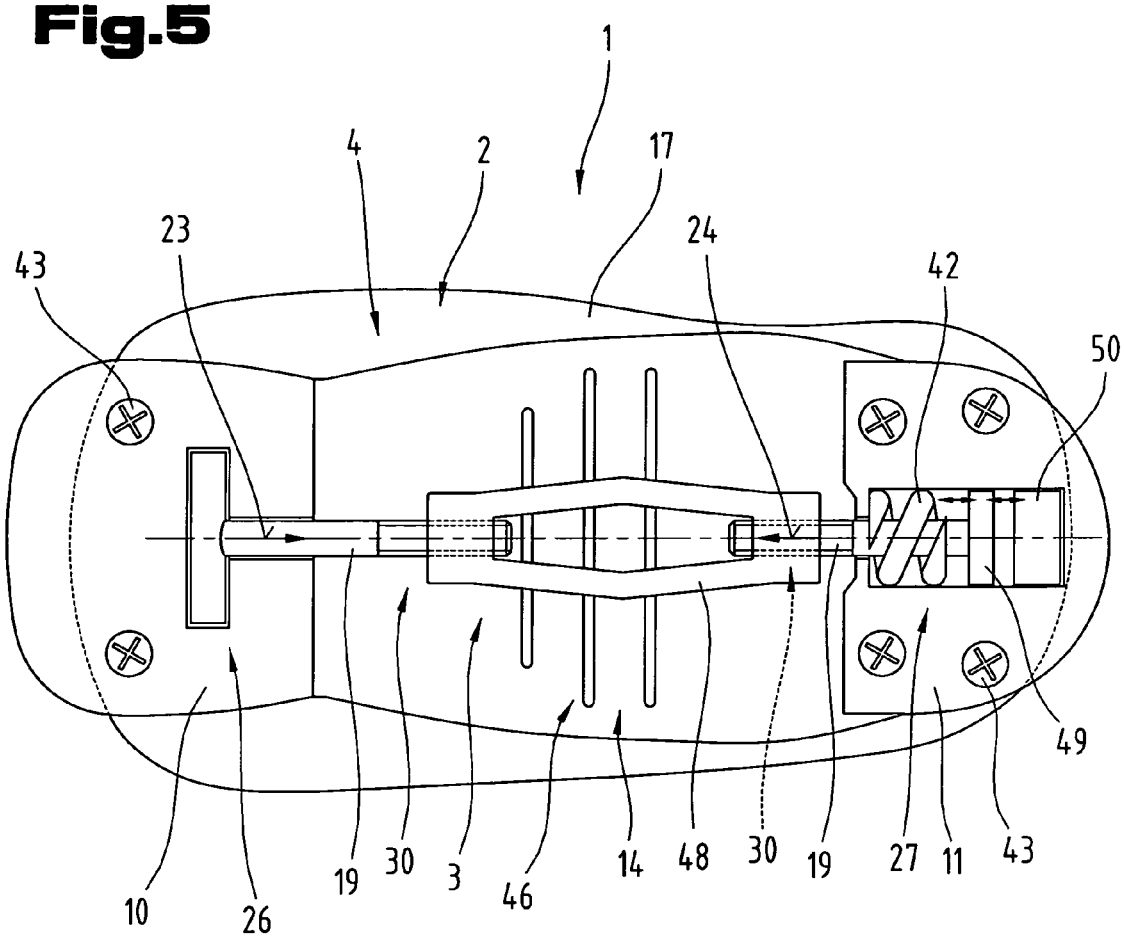
FIG. 5 is a simplified, schematic view from underneath, illustrating an alternative embodiment of an adjusting means for individually influencing the stiffness of the sole system or sports shoe.

FIG. 5 illustrates another variant of an adjusting means 3 for the sole system 4 of an alpine sports shoe 1.

In this instance, the adjusting means 3 has at least one clamping lock 48 with oppositely running thread portions, in particular a left-hand and right-hand thread. By means of these thread portions, the clamping lock 48 can be coupled with the front sole platform 10 on the one hand and with the rear sole platform 11 on the other hand. In particular, the clamping lock 48 is connected via a first tension element 19 and a first thread portion to the front sole platform 10 and is connected via another tension element 19 and another thread portion to the rear sole platform 11. Depending on the rotation or angular position of the clamping lock 48, a variable tensing force can be generated via the two tension elements 19—as indicated by arrows 23, 24—between the two sole platforms 10, 11. In an alternative setting of the clamping lock 48 acting as a thrust means, forces can also be transmitted via the two tension elements 19 in the opposite direction, which causes the sole platforms 10, 111 to move apart from one another or at least assists this action.

Alternatively, the adjusting means 3 may also have a threaded spindle arrangement with a left-hand thread on the one hand and a right-hand thread on the other hand. One of the thread portions is coupled with the front sole platform 10, whilst the other thread portion is coupled with the rear sole platform 11 in an active connection. In particular, matching threaded bores are provided for the distal end portions of the threaded spindle arrangement incorporating the oppositely extending threads, disposed respectively in the front and rear sole platform 10, 11. By rotating the threaded spindle arrangement to the left or right, the two sole platforms 10, 11 can therefore be forced apart from one another or pulled towards one another in a similar manner. In this instance, an individually adjustable thrust or tensing force can be transmitted simply by rotating the threaded spindle arrangement in the corresponding direction. The respective tensing or thrust force can therefore be individually adjusted simply by changing the angular position of the threaded spindle arrangement or the above-mentioned clamping lock 48.

In another example of an advantageous embodiment, a force-transmitting extension 49 of the tension element 19 can be set or positioned via the adjusting means 3 so that it does not transmit any forces to the front and/or the rear sole platform 10, 11 at all, i.e. is inactive. In particular, the force-transmitting extension 49 is positioned so that a force-neutral state prevails, in which no forces are applied by the tension element 19 to the front and rear sole platform 10, 11. To this end, the force-transmitting extension 49 may be disposed at a distance from the thrust bearing surfaces, which are inflexible and/or of an elastic design, as illustrated in the schematic diagram shown in FIG. 5. In particular, there is therefore a distance of a few millimeters between the force-transmitting extension 49 and the at least one spring element 42 or a co-operating buffer element 50 or alternatively a rigid stop.

By varying the settings on the adjusting means 3, the force-transmitting extension 49 can be forced against the spring element 42 so that the two tension elements 19 generate tensing forces between the two sole platforms 10, 11. Alternatively, by using a different setting of the adjusting means 3, the force-transmitting extension 49 can be forced against the inflexible or alternatively elastic buffer element 50, in which case the two tension elements 19 generate thrust forces between the sole platforms 10, 11.

When the two tension elements 19 are in the inactive position illustrated in FIG. 5, a certain flexibility or flexing capacity is imparted to the sole system 4 and foot shell 17, thereby making it relatively more comfortable to walk with the sports shoe 1. When the adjusting means 3 assumes an active position, in particular when the adjusting means 3 respectively the at least one tension element 19 is actively generating a tensing or thrust effect, the resultant state is one primarily one intended for use of the sports shoe 1, in particular an alpine ski shoe 2, in its intended function. When the adjusting means 3 is in the active state, the sole system 4 or foot shell 17 is therefore relatively stiffer so that the sports shoe 1 is better able to fulfill the demands placed on it for practicing alpine skiing.

The embodiments illustrated as examples represent possible design variants of the sports shoe 1 and its sole system 4, and it should be pointed out at this stage that the invention is not specifically limited to the design variants specifically illustrated, and instead the individual design variants may be used in different combinations with one another and these possible variations lie within the reach of the person skilled in this technical field given the disclosed technical teaching. Accordingly, all conceivable design variants which can be obtained by combining individual details of the design variants described and illustrated are possible and fall within the scope of the invention.

For the sake of good order, finally, it should be pointed out that, in order to provide a clearer understanding of the structure, it and its constituent parts are illustrated to a certain extent out of scale and/or on an enlarged scale and/or on a reduced scale.

Above all, the individual embodiments of the subject matter illustrated in FIGS. 1, 2; 3; 4; 5 constitute independent solutions proposed by the invention in their own right. The objectives and associated solutions proposed by the invention may be found in the detailed descriptions of these drawings.

LIST OF REFERENCE NUMBERS

1 Sports shoe
2 Ski shoe
3 Adjusting means
4 Sole system
5 Shoe upper
6 Inner shoe
7 Sole longitudinal axis
8 Coupling means
9 Coupling means
10 Sole platform
11 Sole platform
12 Shoe support surface
13 Shoe support surface
14 Gap
15 Articulated joint
16 Shoe cuff
17 Foot shell
18 Strap and clamping means
19 Tension means
20 Distance
20' Distance
21 Bottom face
22 Clamping length
23 Arrow
24 Arrow
25 Distance
26 Anchoring and thrust bearing means
27 Anchoring and thrust bearing means
28 Recess
29 Recess
30 Thread arrangement
31 Screw body
32 Threaded bore
33 Rotary bearing
34 Rotary bearing
35 Rotation axis
36 Screw head
37 Thrust bearing
38 Support surface
39 Receiving bore
40 Retaining mechanism
41 Zone
42 Spring element
43 Screw means
44 Bottom face
45 Scale
46 Weakening means
47 Cut
48 Clamping lock
49 Force-transmitting extension
50 Buffer element

The invention claimed is:

1. A sports shoe comprising:

(a) a shoe upper comprising a bottom face;

(b) an inner member selected from the group consisting of an inner shoe and an internal lining, said inner member being at least partially accommodated in the shoe upper to embed a user's foot comfortably;

(c) a sole system disposed on said bottom face, said sole system comprising front and rear sole platforms, oppositely-lying first and second end portions, a middle portion between the first and second end portions, and first and second coupling mechanisms disposed respectively in said first and second end portions on said front and rear sole platforms for connection to front and rear coupling elements of a ski binding, the front and rear sole platforms extending from said bottom face; and (d) an adjusting mechanism for varying stiffness of the sole system, said adjusting mechanism comprising at least one tension element having oppositely-lying first and second tension element end portions and a middle tension element portion between the first and second tension element end portions, said first and second tension element end portions being connected respectively to the front sole platform and the rear sole platform, said middle tension element portion extending freely between the front sole platform and the rear sole platform, said at least one tension element remaining essentially dimensionally stable when forces act on the at least one tension element and being mounted so as to be relatively displaceable for applying adjustable positioning forces relative to at least one of said front sole platform and said rear sole platform in a longitudinal direction;

wherein an individually variable tensioning force is exercisable by the at least one tension element between the front sole platform and the rear sole platform, the tensing force being adjustable to counteract a load-induced tendency of a distance between the front sole platform and the rear sole platform to become longer or to induce a tendential, vertical lifting of the middle portion of the sole system; and wherein the middle portion of the sole system extends in an arching arrangement between the front sole platform and the rear sole platform.

2. The sports shoe according to claim 1, wherein the adjusting means is resettable to configure the at least one tension element to transmit thrust forces between the front sole platform and the rear sole platform and to assist the load-induced tendency of the distance between the front sole platform and the rear sole platform to become longer or to induce the tendential vertical lowering of the middle portion of the sole system.

3. The sports shoe according to claim 1, wherein the middle portion between the front sole platform and the rear sole platform is more flexible than the front end portion and the rear end portion.

4. The sports shoe according to claim 1, wherein the at least one tension element is essentially straight.

5. The sports shoe according to claim 1, wherein the at least one tension element is rod-shaped and the middle tension element portion is disposed at a vertical distance from the bottom face of the sole system.

6. The sports shoe according to claim 1, wherein the shoe upper is injection-molded from a hard plastic and at least one of the front and rear sole platforms is connected via screws to the bottom face of the shoe upper.

7. The sports shoe according to claim 1, wherein at least one anchoring mechanism or thrust bearing mechanism for the at least one tension element is provided respectively in the front sole platform and the rear sole platform.

8. The sports shoe according to claim 7, wherein each anchoring mechanism or thrust bearing mechanism has a block and is positively retained in at least one co-operating recess in the front sole platform and the rear sole platform respectively.

9. The sports shoe according to claim 1, wherein, via said first and second tension element end portions of the at least one tension element being connected, respectively, to the front sole platform of the sole system and the rear sole platform of the sole system, the at least one tension element is attached to the bottom face of the shoe upper so as not to fall off or tear off.

10. The sports shoe according to claim 1, wherein a thread arrangement is provided between the at least one tension element and at least one of the front and rear sole platforms, said thread arrangement effecting a relative movement or transmitting force between said at least one tension element and said at least one of the front and rear sole platforms.

11. The sports shoe according to claim 10, wherein the thread arrangement comprises a screw body having a screw head grippable from a shoe tip end of the sole system or from a heel end of the sole system.

12. The sports shoe according to claim 11, wherein the screw body is oriented toward a sole longitudinal axis and is retained by a rotary bearing in the front sole platform or the rear sole platform so as to permit rotational movement but to block the screw body axially.

13. The sports shoe according to claim 1, wherein at least one elastically flexible spring element is provided within the distance between the at least one tension element and at least one of the front sole platform and the rear sole platform.

14. The sports shoe according to claim 1, wherein a pair of profiled tension elements is provided, extending essentially parallel.

15. The sports shoe according to claim 14, wherein the profiled tension elements are disposed in two lateral peripheral portions of at least one of the front sole platform and the rear sole platform.

16. The sports shoe according to claim 14, wherein the two tension elements extend in a diverging V-shape from the rear sole platform in a direction towards the front sole platform.

17. The sports shoe according to claim 1, wherein the front sole platform and the rear sole platform in conjunction with the at least one tension element constitute a pre-assembled unit screwable to the bottom face of the shoe upper.

18. The sports shoe according to claim 7, wherein the anchoring mechanism or thrust bearing mechanism comprises a block or plate thread body injected into or positively inserted into at least one of the front sole platform and the rear sole platform.

19. The sports shoe according to claim 1, wherein the at least one tension element has a thread arrangement in at least one end portion to provide a relatively adjustable or force-coupled connection to at least one of the front and rear sole platforms.

20. The sports shoe according to claim 1, wherein at least one end portion of the at least one tension element has a slotted, Phillips, or socket head screw head.

21. The sports shoe according to claim 1, wherein the at least one tension element has at least one abutment surface or at least one projection to provide an axially non-displaceable fixture relative to one of the front and rear sole platforms.

22. The sports shoe according to claim 1, wherein the at least one tension element is provided with a rotary bearing, said rotary bearing serving as a rotatable but radially and axially secured bearing for the at least one tension element with respect to at least one of the front and rear sole platforms.

23. The sports shoe according to claim 1, wherein the adjusting mechanism has at least one clamping lock comprising oppositely running thread portions, wherein the at least one clamping lock is connected via a first tension element and a first thread portion to the front sole platform and via another tension element and another thread portion to the rear sole platform.

24. The sports shoe according to claim 1, wherein the adjusting mechanism has a threaded spindle arrangement comprising a left-hand thread and a right-hand thread connected to the front and rear sole platforms respectively in a respective distal end portion by a respective co-operating threaded bore.

25. The sports shoe according to claim 1, wherein a force-transmitting extension in at least one sole platform of the front and rear sole platform is disposed at a movable distance from a thrust bearing or stop surface or from an elastomeric body or spring element in the at least one sole platform where the force-transmitting extension is free of force.

26. The sports shoe according to claim 1, wherein the at least one tension element has a length and carbon fiber composite materials at least within a major part of the length.

27. A sports shoe comprising:

(a) a shoe upper comprising a bottom face;

(b) an inner member selected from the group consisting of an inner shoe and an internal lining, said inner member being at least partially accommodated in the shoe upper to embed a user's foot comfortably;

(c) a sole system disposed on said bottom face, said sole system comprising front and rear sole platforms, oppositely-lying first and second end portions, a middle portion between the first and second end portions, and first and second coupling mechanisms disposed respectively in said first and second end portions on said front and rear sole platforms for connection to front and rear coupling elements of a ski binding, the front and rear sole platforms extending from said bottom face; and (d) an adjusting mechanism for varying stiffness of the sole system, said adjusting mechanism comprising at least one tension element having oppositely-lying first and second tension element end portions and a middle tension element portion between the first and second tension element end portions, said first and second tension element end portions being connected respectively to the front sole platform and the rear sole platform, said middle tension element portion extending freely between the front sole platform and the rear sole platform, said at least one tension element remaining essentially dimensionally stable when forces act on the at least one tension element and being mounted so as to be relatively displaceable for applying adjustable positioning forces relative to at least one of said front sole platform and said rear sole platform in a longitudinal direction;

wherein an individually variable tensioning force is exercisable by the at least one tension element between the front sole platform and the rear sole platform, the tensing force being adjustable to counteract a load-induced tendency of a distance between the front sole platform and the rear sole platform to become longer or to induce a tendential, vertical lifting of the middle portion of the sole system; and wherein the at least one tension element is rod-shaped and the middle tension element portion is disposed at a vertical distance from the bottom face of the sole system.

28. A sports shoe comprising:

(a) a shoe upper comprising a bottom face;

(b) an inner member selected from the group consisting of an inner shoe and an internal lining, said inner member being at least partially accommodated in the shoe upper to embed a user's foot comfortably;

(c) a sole system disposed on said bottom face, said sole system comprising front and rear sole platforms, oppositely-lying first and second end portions, a middle portion between the first and second end portions, and first and second coupling mechanisms disposed respectively in said first and second end portions on said front and rear sole platforms for connection to front and rear coupling elements of a ski binding, the front and rear sole platforms extending from said bottom face; and (d) an adjusting mechanism for varying stiffness of the sole system, said adjusting mechanism comprising at least one tension element having oppositely-lying first and second tension element end portions and a middle tension element portion between the first and second tension element end portions, said first and second tension element end portions being connected respectively to the front sole platform and the rear sole platform, said middle tension element portion extending freely between the front sole platform and the rear sole platform, said at least one tension element remaining essentially dimensionally stable when forces act on the at least one tension element and being mounted so as to be relatively displaceable for applying adjustable positioning forces relative to at least one of said front sole platform and said rear sole platform in a longitudinal direction;

wherein an individually variable tensioning force is exercisable by the at least one tension element between the front sole platform and the rear sole platform, the tensing force being adjustable to counteract a load-induced tendency of a distance between the front sole platform and the rear sole platform to become longer or to induce a tendential, vertical lifting of the middle portion of the sole system; and wherein the front sole platform and the rear sole platform in conjunction with the at least one tension element constitute a pre-assembled unit screwable to the bottom face of the shoe upper.

* * * * *